United States Patent [19]

Gallant

[11] Patent Number: 4,702,169

[45] Date of Patent: Oct. 27, 1987

[54] FIRING TRAIN FUNCTION INDICATOR

[75] Inventor: W. Keith Gallant, Plymouth, Minn.

[73] Assignee: Honeywell Inc., Mineapolis, Minn.

[21] Appl. No.: 8,237

[22] Filed: Jan. 29, 1987

[51] Int. Cl.[4] ..... F42B 23/24

[52] U.S. Cl. ..... 102/401

[58] Field of Search ..... 102/401, 404, 424, 426, 102/427

[56] References Cited

U.S. PATENT DOCUMENTS 4,292,861 10/1981 Thornhill, Jr. et al. ..... 102/401

FOREIGN PATENT DOCUMENTS 3127522 1/1983 Fed. Rep. of Germany ..... 102/401
3151674 7/1983 Fed. Rep. of Germany ..... 102/426
86/03827 7/1986 World Int. Prop. O. ..... 102/401
12797 of 1914 United Kingdom ..... 102/404

*Primary Examiner*—Charles T. Jordan
*Attorney, Agent, or Firm*—Roger W. Jensen

[57] ABSTRACT

A firing train function indicator 10 for a self neutralizing recoverable land mine 16. An explosive bolt 20 is used to hold a helical spring 44 in a compressed state. The upper portion 30 of the bolt 20 is attached to one end of the spring 44 and the other end 32 of the explosive bolt 20 is attached to base 38 of indicator 10. A highly visible inverted cup-shaped flag 48 is also attached to the upper portion 30 of the explosive bolt 20. The detonator 18 of the explosive bolt 20 is fired when the mine 16 self neutralizes to separate the upper portion 30 of the bolt 20 from its lower portion 32. The spring 44 is then free to expand raising the flag 48 above the self neutralized mine 16. A flag 48 so deployed, identifies the location of a self neutralized mine 16 and is a reliable indicator to recovery personnel that the mine 16 is in fact safe to approach and recover.

7 Claims, 3 Drawing Figures

FIRING TRAIN FUNCTION INDICATOR

CROSS-REFERENCE TO RELATED APPLICATIONS

The following application, Ser. No. 004,937, filed Jan. 30, 1987, "Align at Fire, Safe and Arm, and Power Supply Module for a Land Mine" by Stephen A. Haglund, Arthur M. Lohman and Sharon A. Pickering-Johnson, the disclosure of which is hereby incorporated by reference into this application, was filed concurrently with this application. Both applications are assigned to the same assignee.

BACKGROUND OF THE INVENTION

This invention is in the field of safing and arming devices for land mines, and more particularly related to a visual safe indicator device which when displayed identifies the location of a land mine that has self-neutralized and thus is safe to recover. The device, since it is slaved off the firing train detonator of the land mine, eliminates the possibility that a mine displaying the device is not safe to approach and recover.

DESCRIPTION OF RELATED ART

Heretofore, most land mines have been designed to self-destruct at the end of their useful lives. There has recently been developed a safing and arming and fuzing subsystem for a land mine that permits the mine to self neutralize at the end of its useful life, normally after the lapse of a predetermined period of time or upon the occurrence of some other predetermined condition. Such a safing and arming subsystem is described and claimed in the application entitled "Align at Fire, Safe and Arm, and Power Supply (AFSAP) Module" for a land mine further identified in the section of this application entitled Cross-Reference to Related Applications. A mine that has self neutralized is safe to recover and refurbish. Thus, there is a need to provide a land mine that has a self neutralizing capability with a firing train function indicator that provides reliable confirmation to recovery personnel that the firing train of the mine has been aborted, or that the mine has self neutralized, and that aids in locating the position of a mine that has self neutralized.

BRIEF SUMMARY OF THE INVENTION

The present invention provides a firing train function indicator, or a visual safe indicator, for a land mine that has the capability, under predetermined circumstances, to neutralize itself, or become self neutralized. In the above identified cross-referenced application, an AFSAP module is described in which the firing train detonator is fired when the firing train is interrupted to self neutralize the mine. Once the firing train detonator is fired, or functioned, with the firing train of the AFSAP module interrupted, no other mechanism is available for the mine's fusing subsystem to detonate the mine's warhead. Thus, the mine is safe for recovery personnel to approach and recover and later to repair and/or refurbish. The visual safe indicator of this invention utilizes a STACER helical spring which is a commercially available product of the Hunter Spring Corp. A STACER spring is formed from a strip of resilient material which has two states. When compressed, the spiral strip of resilient material is compressed into a cylindrical coil. When unrestrained, the coil expands to form a closed helix having a dimension along its helical axis which is from 10–15 times that of the width of the strip of material from which the helical spring is made. The STACER spring is placed about an explosive bolt that holds the spring in its compressed state. A housing is secured to the lower portion of the bolt and an end piece is secured to the upper portion of the bolt. A detonator is located in the lower portion of the explosive bolt which when detonated causes the bolt to fracture separating the bolt into two portions, or ends. A flag, a hollow cylindrical cup shaped device is secured to the upper end of the bolt. The exterior surface of the flag is provided with a highly visible coating. When assembled, the housing and end piece encloses the STACER spring, the flag, and the explosive bolt in a weather-tight compartment. The housing is provided with a mounting device so that the visual safe indicator can be mounted on the housing of the (AFSAP) module of a land mine with the detonator of the explosive bolts in communication with the firing train detonator of the AFSAP module. Functioning, or initiating, the firing train detonator of the module causes the detonator of the explosive bolt to explode. When the detonator of the explosive bolt functions, or explodes, the bolt separates into two portions. This permits the STACER spring to expand to its full length raising the highly visible flag secured to its end piece a substantial distance above its compressed position.

Since the visual safe indicator is released, or displayed, only when the firing train detonator of the AFSAP module of the land mine is fired, or it is slaved off of the firing train detonator, recovery personnel when they observe the flag can be certain that the firing tain detonator of the mine's module was fired while the firing tain was interrupted and that the mine no longer has the capability of being detonated by the mine's fusing subsystem and thus is safe to recover. In addition, deploying a highly visible flag on a stable support which extends a substantial distance above the mine with which the flag is connected, a distance of from one to one-and-a-half feet in the preferred embodiment, significantly aids in locating a self neutralized mine.

It is therefore an object of this invention to provide a firing train function indicator that provides visual proof when a land mine has self neutralized and thus is safe to approach and recover.

It is another object of this invention to provide a firing train function indicator that displays a highly visible device only when the firing train detonator for the warhead of a land mine with which the indicator is associated has been detonated while the firing train for that warhead is interrupted.

It is still another object of this invention to provide a visual safe indicator for a land mine which when displayed indicates that the mine is safe to approach and recover and in addition facilitates locating such a mine.

BRIEF DESCRIPTION OF THE DRAWINGS

Other objects, features and advantages of the invention will be readily apparent from the following description of the preferred embodiment thereof, taken in conjunction with the accompanying drawings, although variations and modifications may be effected without departing from the spirit and scope of the novel concepts of the disclosure, and in which.

DESCRIPTION OF THE PREFERRED EMBODIMENT

Figure 1:
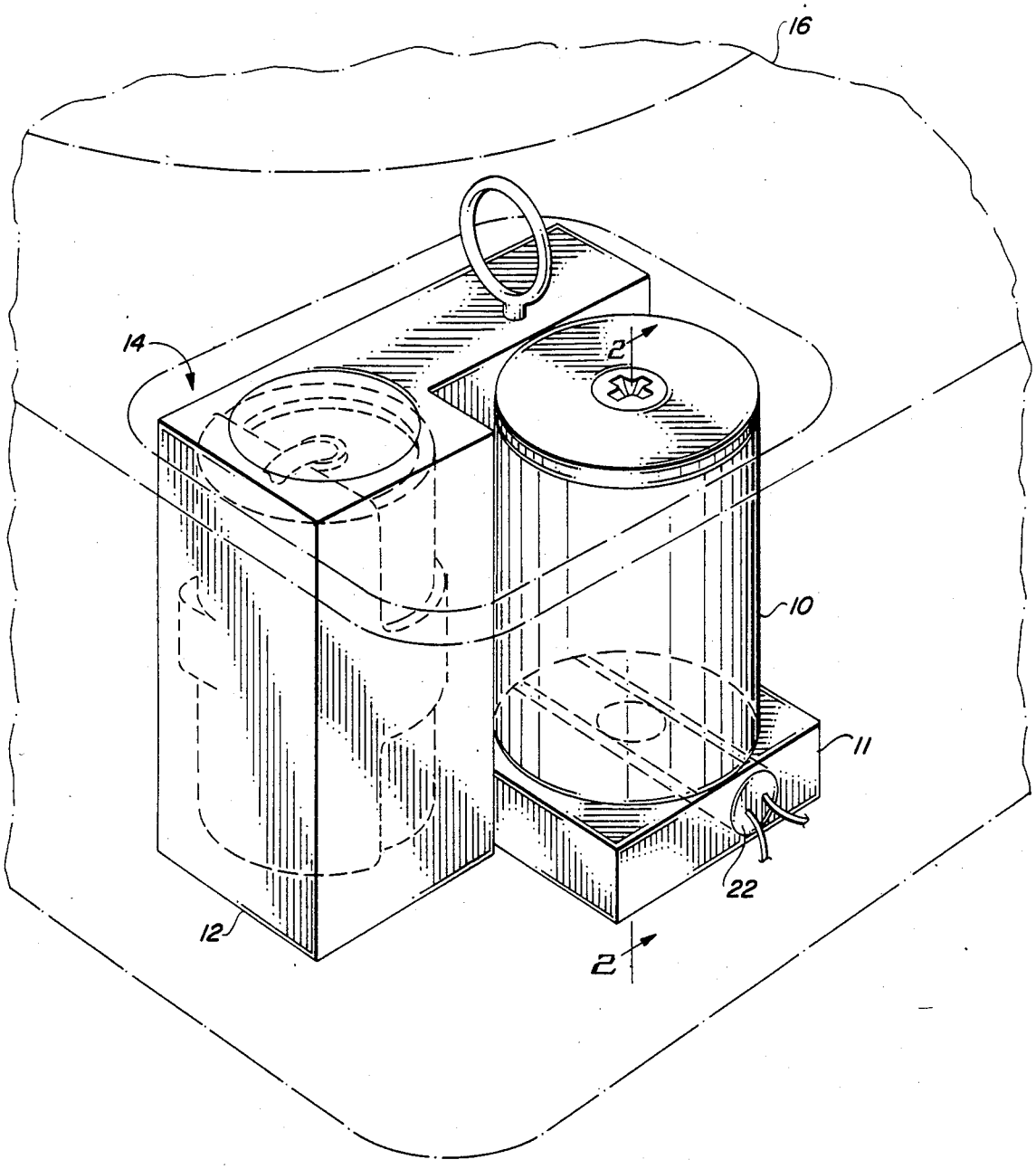
FIG. 1 is a perspective view of a preferred embodiment of the firing train function indicator mounted on an AFSAP module of a land mine.

In FIG. 1, firing train function indicator, or visual safe indicator, 10 is mounted on indicator support portion 11 of housing 12 of replaceable (AFSAP) module 14. Module 14 is removably mounted on recoverable land mine 16. For additional information on the structure and function of mine 16 and module 14, reference is made to the application entitled "Align at Fire, Safe and Arm, and Power Supply Module" further identified in the section of this application entitled "Cross Reference to Related Applications".

Figure 2:
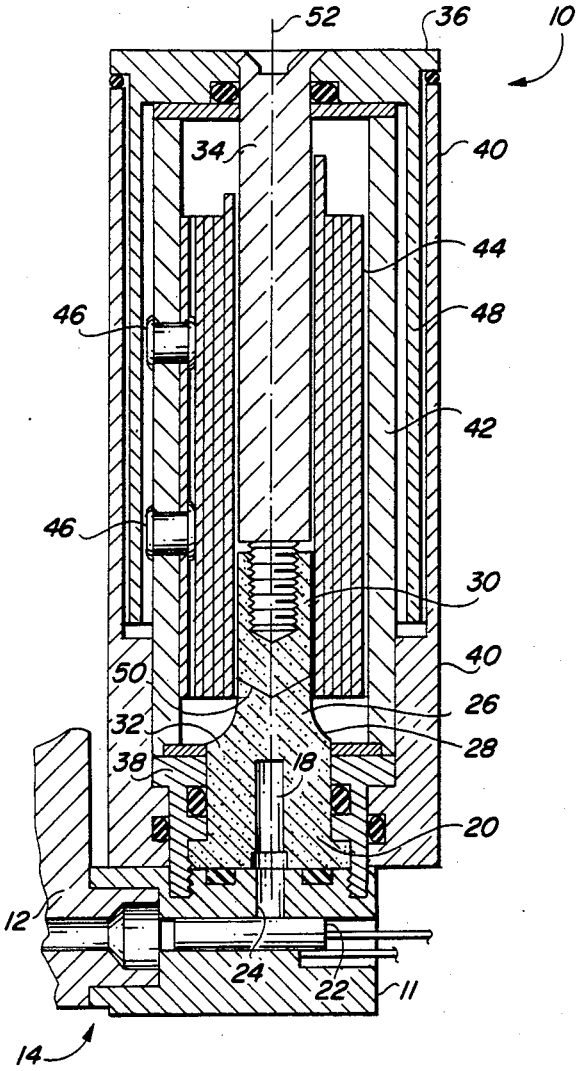
FIG. 2 is a section on line 2—2 of FIG. 1.

In FIG. 2, visual safe indicator 10 is mounted on support portion 11 of housing 12 of AFSAP module 14, so that indicator 10's stab sensitive detonator 18 of explosive bolt 20 is in communication with electrically initiated firing train detonator 22 of module 14 through visual safe indicator lead 24 formed in support portion 11. The body 26 of bolt 20 is provided with circumferential stress concentrating contour 28 which divides bolt body 26 into an upper portion 30 and a lower portion 32. End piece 34 is secured to the upper end of upper portion 30 of bolt 20 and top cover 36 is secured to end piece 34 in any conventional manner. Base 38 is fitted around lower portion 32 of bolt 20 and outer body 40 fits around base 38. Inner housing 42 is secured to outer body 40. Spring 44 is located within inner housing 42 and around bolt 20 and end piece 34.

STACER spring 44 is made of a strip of resilient material, such as spring steel, which can be compressed into the form of a cylindrical coil as seen in FIG. 2. The outer convolution, or end, 45 of spring 44 is riveted to the inner housing 42 by rivets 46 and the inner convolution, or inner end, 47 is secured to end piece 34 by being welded thereto, for example. Depending hollow cylindrical portion, or flag 48 of top cover 36 fits in between inner housing 42 and outer body 40 when spring 44 is in its compressed state. Helical spring 44 is retained in its compressed state by end piece 34, inner housing 42, base 38 and bolt 20.

In the preferred embodiment, base 38 is illustrated as being threadably secured to support 11 of module 14. Conventional seals are provided to make the connections between firing train function indicator 10 and support 11 of housing 12 weather proof, or water tight, as well as to make the interior of indicator 10 weather tight.

Figure 3:
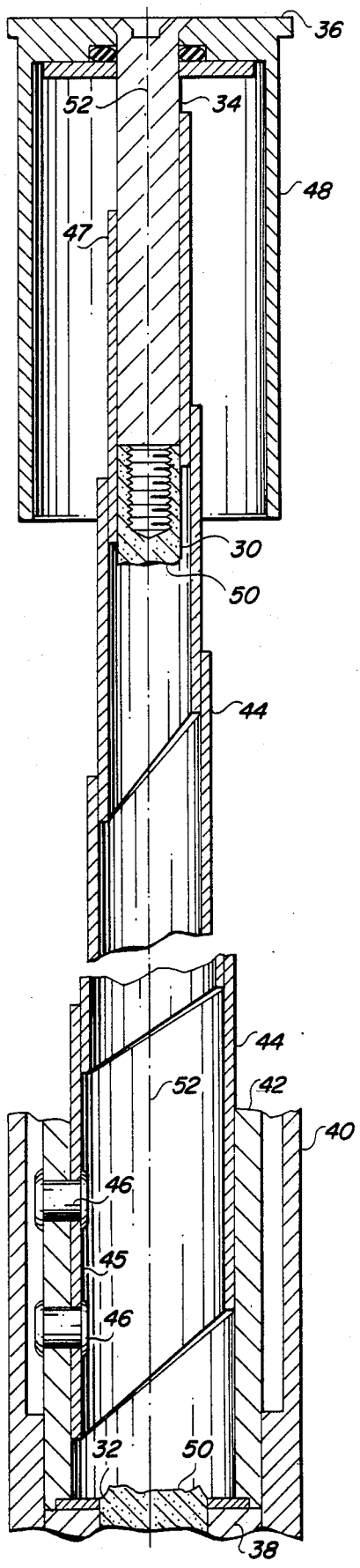
FIG. 3 is a section similar to FIG. 2, but with the spring broken apart to illustrate its characteristics when deployed.

STACER spring 44 in its normal, non-compressed state, forms a closed helix as is best illustrated in FIGS. 3. A closed helix is defined as being a helix in which the edges of the strip of material from which the helix is made overlap.

When mine 16 self neutralizes, it does so by causing firing train detonator 22 to detonate while the firing train of AFSAP module 14 is interrupted. Fragments and hot gases from the detonation of detonator 22 pass through visual safe indicator lead 24 and strike, or impinge, on the base of stab sensitive detonator 18 of explosive bolt 20. This causes detonator 18 to detonate, or function. When detonator 18 functions, shock and pressure from the explosion of detonator 18 causes bolt body 26 to fracture along fracture line 50 which is determined in part by circumferential contour 28. When bolt body 26 fractures, end piece 34 and flag 36 are released from base 38 and outer body 40, and helical spring 44 is free to expand to its normal, or expanded, state.

STACER spring 44 in its compressed state as illustrated in FIG. 2 is substantially symmetric about axis of symmetry 52 of firing train function indicator 10. When bolt body 26 fractures, spring 44 expands to its unrestrained state forming a closed helix, the axis of which substantially coincides with the axis of symmetry 52 of visual safe indicator 10. The expansion of helical spring 44 raises flag 36 to a height of 10–15 times greater than the height of the helical spring 14 in its compressed state, or about 12 inches in the preferred embodiment and provides a relatively rigid support for top support 36 and flag 48 which can be made integral with support 36. The outer surface of flag 48 is covered, or provided with a highly visible surface, so that flag 48 is very visible when displayed or deployed.

It goes without saying that when detonator 22 is fired with the firing rain of the AFSAP module 14 being aligned, that the explosion of the warhead of mine 16 destroys visual safe indicator 10.

From the foregoing, it is obvious that the visual safe indicator of this invention when deployed provides a highly visible and readily recognizable indication that a mine with which it is associated has self neutralized and is safe for recovery personnel to approach and recover.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What is claimed is:

1. In a land mine 16 having a firing train and means for self neutralizing its firing train, the improvements comprising:

a visual safe indicator 10 mounted on the land mine 16, said visual safe indicator including an explosive bolt 20 having an upper portion 30 and a lower portion 32 for explosively separating the upper portion 30 from the lower portion 32;

compressed spring means 44 having two ends 45, 47;

means for securing one end 45 of the compressed spring means 44 to the upper portion 30 of the explosive bolt and the other end 47 of the compressed spring means 44 to the lower portion 47 of the explosive bolt;

highly visible means 48 attached to the upper portion 30 of the explosive bolt 20; and means for mounting 11 the visual safe indicator 10 on the land mine 16 so that when the mine 16 self neutralizes, the explosive bolt 20 separates its upper portion 30 from its lower portion 32 for deploying the highly visible means 48.

2. In combination:

a land mine 18 having a firing train having an interrupted state and an aligned state and including a firing train detonator 22, said mine including means for detonating its firing train detonator 22 while the land mine's firing train is interrupted; and a visual safe indicator 10 including an explosive bolt 20 having an upper portion 30 and a lower portion 32, an explosive bolt detonator 18 positioned in the lower portion 32 of the explosive bolt 20 for causing the two portions 30, 32 of the explosive bolt 20 to separate when the explosive bolt detonator 18 detonates;

a compressed helical spring 44 substantially in the form of a cylindrical coil, one end 45 of the coil 44 being secured to the lower portion 32 of the explosive bolt 20 and the other end 47 to the upper portion 30 of the explosive bolt 20;

flag means 48 attached to the upper portion 30 of the explosive bolt 20; and means for mounting 38 the lower portion 32 of the explosive bolt 20 on the land mine 16 so that the explosive bolt detonator 18 will be detonated when the firing train detonator 22 of the land mine 16 is detonated while the firing train is in its interrupted state to permit the spring 44 to expand to raise the flag means 48 above land mine 16.

3. The combination of claim 2 in which the explosive bolt detonator is a stab sensitive detonator 18 which is in communication with the firing train detonator 22.

4. The combination of claim 3 in which the expanded helical spring 44 forms a closed helix.

5. The combination of claim 4 in which the flag means 48 includes means for rendering the flag means 48 highly visible.

6. A firing train function indicator 10 comprising:

a strip of resilient material 44 having two ends and two states, a compressed state and a normal state, said material forming a substantially cylindrical coil in its compressed state and a closed helix in its normal state;

an explosive bolt 20, said explosive bolt having an upper portion 30 and a lower portion 32;

a stab sensitive detonator 18 for severing the upper portion 30 of the explosive bolt 20 from the lower portion 32 when detonated, said stab sensitive detonator 18 being mounted in the lower portion 32 of the explosive bolt 20;

a housing 42 secured to the lower portion 32 of the bolt 20;

an end piece 34 secured to the upper portion 30 of the explosive bolt 20;

flag means 36 attached to the end piece 34;

one end 45 of the strip of resilient material 44 being secured to the housing 42 and the other end 47 to the end piece 34; said strip 44 being held in its compressed state between the housing 44 and the end piece 34 by the explosive bolt 20;

said end piece 34 and housing forming 42 a weather tight enclosure for the explosive bolt 20 and the compressed strip of resilient material 44;

means for mounting 38, 11, 14 the visual safe indicator 10 on a land mine 16 so that the stab sensitive detonator 18 of indicator 10 is in direct communication with a firing train detonator 22 of the mine 16 which detonator 22 is fired when the mine 16 self neutralizes to detonate the stab sensitive detonator 18 of the explosive bolt 20 to separate the upper portion 30 of the explosive bolt 20 from the lower portion 32 to permit the strip of resilient material 44 to expand to its normal stage to deploy the flag means 36.

7. A firing train function indicator 10 is defined in claim 6 in which the flag means 36 has a surface which renders the flag means 36 highly visible.

* * * * *